United States Patent [19]

Credle, Jr. et al.

[11] Patent Number: 4,801,048

[45] **Date of Patent: * Jan. 31, 1989**

[54] BEVERAGE DISPENSER

[75] Inventors: William S. Credle, Jr., Stone Mountain, Ga.; Alfred A. Schroeder, San Antonio, Tex.

[73] Assignee: The Coca-Cola Company, Atlanta, Ga.

[ * ] Notice: The portion of the term of this patent subsequent to May 18, 2005 has been disclaimed.

[21] Appl. No.: 145,942

[22] Filed: Jan. 20, 1988

Related U.S. Application Data

[63] Continuation of Ser. No. 944,637, Dec. 19, 1986, Pat. No. 4,781,310.

[51] Int. Cl.[4] ..... B67D 5/56

[52] U.S. Cl. ..... 222/129.1; 222/146.6; 261/DIG. 7; 62/394

[58] Field of Search ..... 222/105, 129.1–129.4, 222/146.6; 261/DIG.7; 62/390, 394, 396

[56] References Cited

U.S. PATENT DOCUMENTS

| | | | |
|---|---|---|---|
| 2,502,610 | 4/1950 | Wegman | 225/21 |
| 3,215,312 | 11/1965 | Guzzi | 222/129.1 |
| 3,224,641 | 12/1965 | Morgan | 222/129.1 |
| 3,892,335 | 7/1975 | Schroeder | 222/129.1 |
| 4,304,736 | 12/1981 | McMillin et al. | 261/35 |
| 4,333,587 | 6/1982 | Fessler et al. | 222/146.6 X |
| 4,555,371 | 11/1985 | Jeans | 261/DIG.7 |
| 4,566,287 | 1/1986 | Schmidt et al. | 62/188 |
| 4,592,490 | 6/1986 | McMichael | 222/129.1 |
| 4,615,466 | 10/1986 | Credle, Jr. | 222/129.1 |
| 4,635,825 | 1/1987 | Tulasne | 222/129.1 |
| 4,742,939 | 5/1988 | Galockin | 222/146.6 X |

*Primary Examiner*—Joseph J. Rolla
*Assistant Examiner*—Gregory L. Huson
*Attorney, Agent, or Firm*—Thomas R. Boston; W. Dexter Brooks

[57] ABSTRACT

A beverage dispenser that can be used with either figals or bag-in-box. The dispenser includes a built-in carbonator, and when used with a bag-in-box syrup supply it includes a plurality of built-in syrup pumps, one for each of four, five or six valves. The dispenser includes an easily removable refrigeration unit and an easily removable carbonator unit.

6 Claims, 4 Drawing Sheets

BEVERAGE DISPENSER

This is a continuation of application Ser. No. 944,637 filed on Dec. 9, 1986 now U.S Pat. No. 4,781,310.

BACKGROUND OF THE INVENTION 1. Field of the Invention

This invention relates to beverage dispensers, and in a preferred embodiment thereof to a countertop unit for use with either a bag-in-box or a figal and having built-in syrup pumps and carbonator.

2. Description of the Prior Art

Present commercially available beverage dispensers of the type adapted to fit on top of a counter and having a plurality of beverage dispensing valves, each for a different beverage, are either gravity dispensers or pressure dispensers. The gravity dispensers employ one or more syrup tanks in the top of the dispenser which are easily re-filled with syrup as they become empty. Pressure dispensers are fed syrup from a pressure source such as a stainless steel syrup tank (known in this art as figals) pressurized by $CO_2$ gas, or such as a bag-in-box in which syrup is pumped out of a non-pressurized bag and to the beverage dispenser. These two types of dispensers employ different dispensing valves. These dispensers normally do not include a built in carbonator or a built-in syrup pump. The pressure dispensers that operate with the bag-in-box system are usually connected to syrup pumps which are mounted on a wall of the restaurant.

It is an object of the present invention to provide a beverage dispenser for low volume markets which is made of low cost, readily available materials and components, and which is easy to manufacture.

It is another object of the present invention to provide a beverage dispenser having a refrigeration deck that is easily removable (as are the components thereof) for service without having to remove $CO_2$ lines and water lines It is another object of the present invention to provide a beverage dispenser having a modular carbonator which is easily removable (as are the components thereof) for servicing.

It is a further object of the present invention to provide a beverage dispenser that is easily convertible for use with either a bag-in-box system or with figals.

It is a still further object of the present invention to provide a beverage dispenser having built-in bag-in-box syrup pumps and a built-in carbonator.

SUMMARY OF THE INVENTION

A countertop beverage dispenser system in which the beverage dispenser includes a built-in carbonator and also includes built-in syrup pumps when used with the bag-in-box system. The beverage dispenser includes an easily removable refrigeration deck and an easily removable carbonator deck for ease of servicing. The beverage dispenser can be easily converted from use with figals to use with a bag-in-box, by mounting syrup pumps in the dispenser and connecting an adapter to the syrup inlet conduit. The same beverage dispenser design can be used to build a dispenser having for example, either four, five or six dispensing valves, and can be easily set up for use with either bag-in-box or figals, and in fact can be used with both figals and the bag-in-box system at the same time, if desired.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
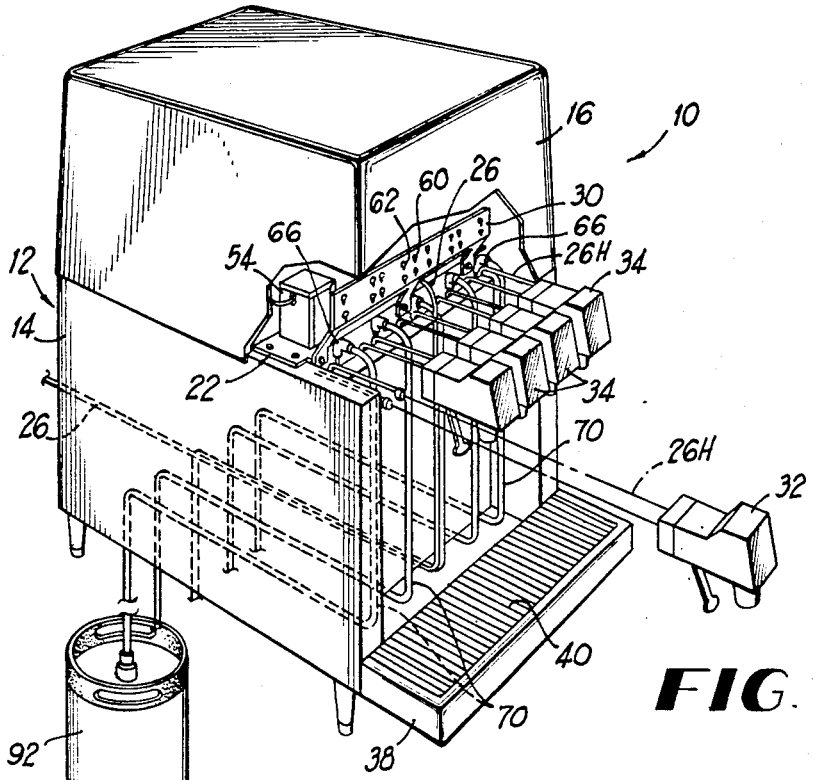
FIG. 1 is a partly broken away, front perspective view of the beverage dispenser of the present invention setup for use as a pressure dispenser with figals.
Figure 2:
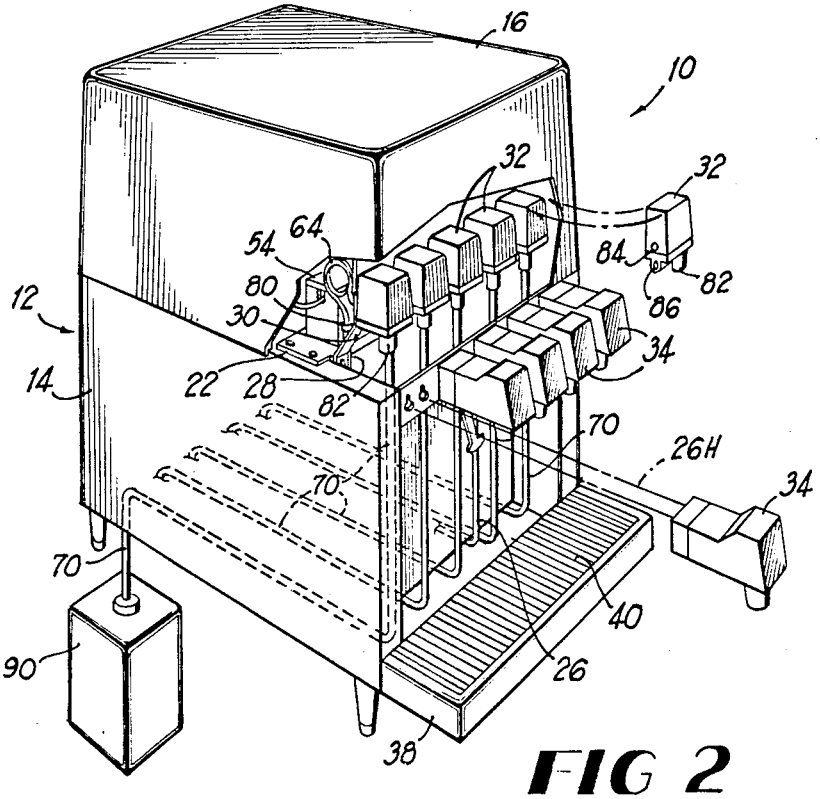
FIG. 2 is a perspective view similar to FIG. 1 but showing the beverage dispenser setup for use with the bag-in-box system.
Figure 3:
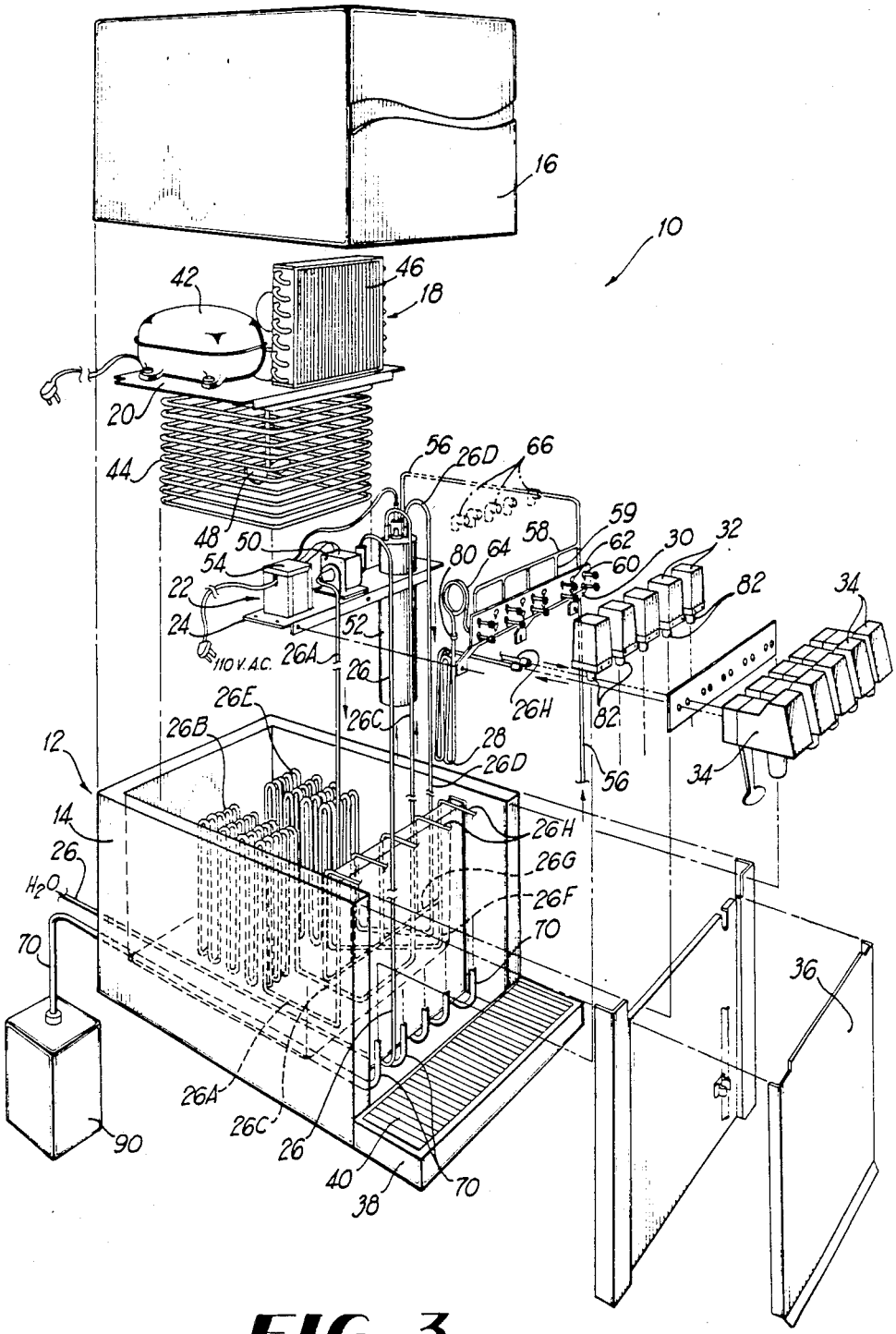
FIG. 3 is an exploded perspective view of the dispenser of FIG. 2.
Figure 4:
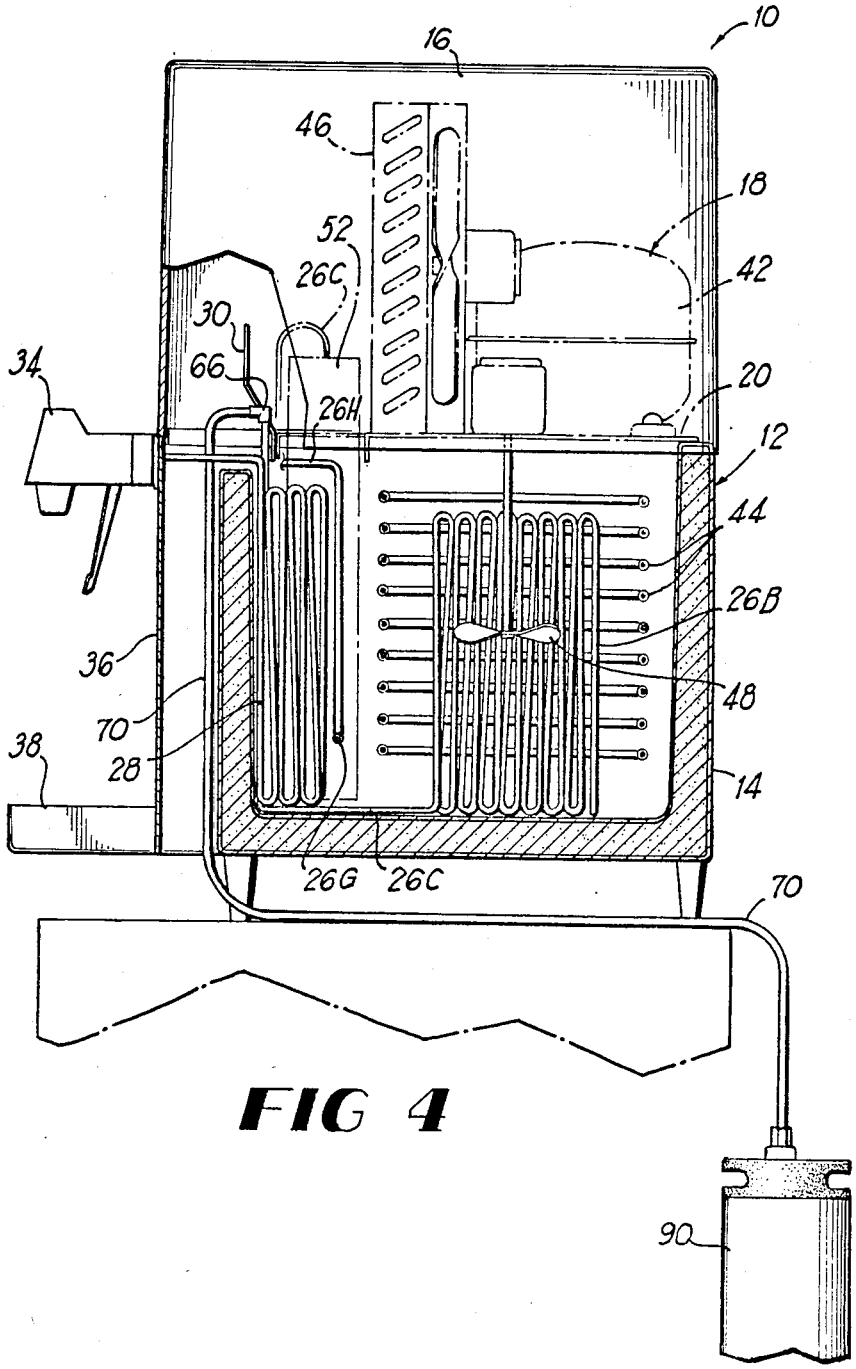
FIG. 4 is a cross-sectional side view of the dispenser of FIG. 1.
Figure 5:
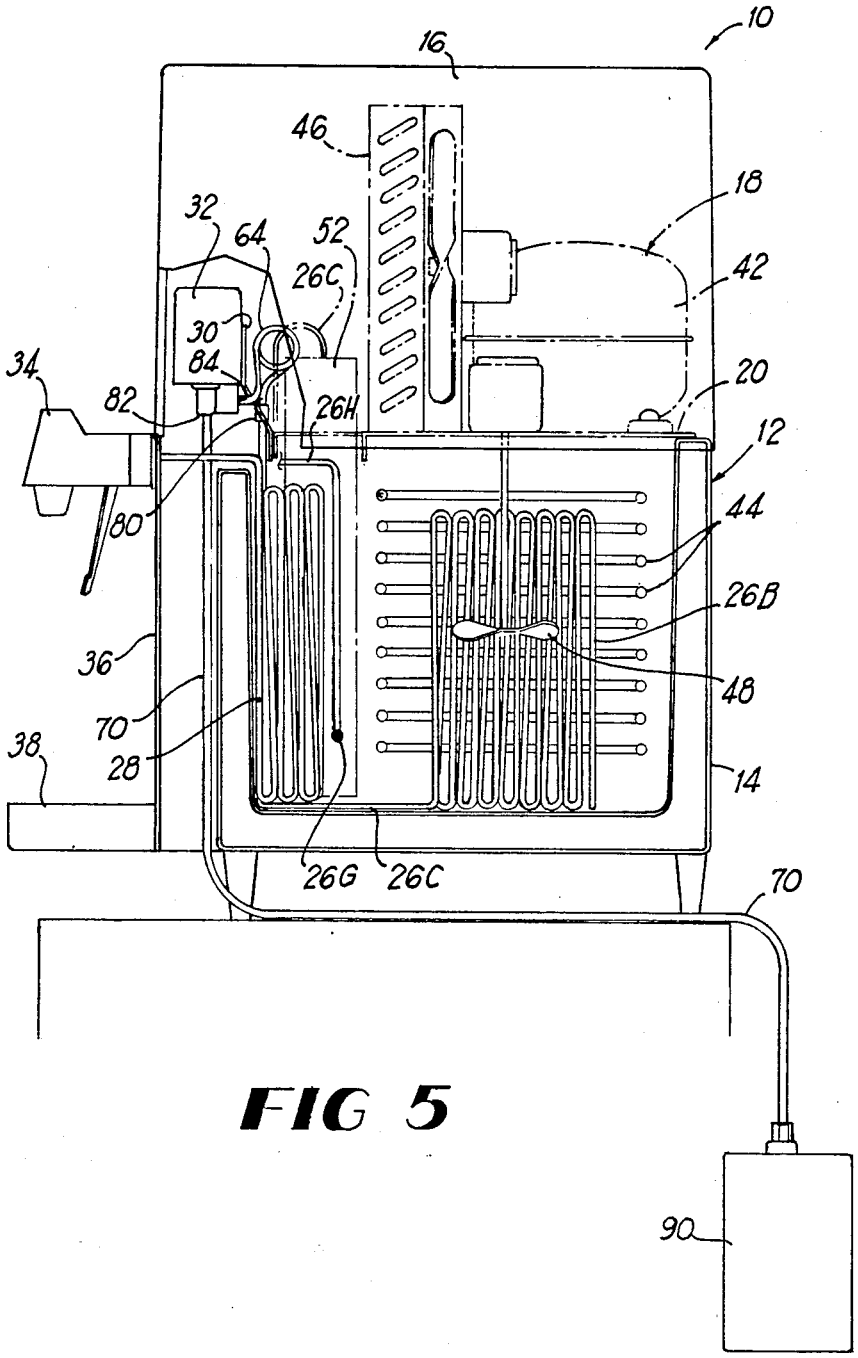
FIG. 5 is a partly cross-sectional partly broken away side view of the dispenser of FIG. 2.

With reference now to the drawings, FIGS. 1 to 5 show a countertop beverage dispenser 10 according to the present invention. The dispenser 10 includes a housing 12 comprising a tank 14 and a bonnet 16, a mechanical refrigeration unit 18 mounted on a refrigeration deck 20, a built-in carbonator unit 22 mounted on a carbonator deck 24, a water inlet conduit 26, a plurality of syrup cooling coils 28, a pump mounting bracket 30, a plurality of syrup pumps 32 mounted on the bracket 30 (when the dispenser 10 is arranged for use with a bag-in-box system), and a plurality of beverage dispensing valves 34. Each of the valves 34 is connected to a water inlet conduit and to a syrup inlet conduit. The dispenser 10 includes a conventional vertical splash plate 36, a drip pan 38, and a grate or cup rest 40 located beneath the valves 34.

The refrigeration unit 18 includes the support plate refrigerator deck 20 that rests on top of the tank 14. The evarporator or cooling coils 42 extend below the plate 20 and produce an ice bank in an ice water bath in the tank 14 to cool the water and syrup in the water conduit 26 and in the syrup cooling coils 28, respectively. The refrigerator unit 18 is easily removable from the dispenser 10 without having to disconnect any water or syrup lines and is also easily accessible for removal of individual components from the refrigerator deck 20 which includes the standard components such as the compressor 42, the evaporator coil 44, the condenser coil 46, and the agitator 48.

The carbonator deck 24 also sits on top of the tank 14 and is easily removable from the dispenser 10, and the components of the carbonator unit are easily accessible and removable from the carbonator unit 22 for ease of service. The carbonator unit 22 includes the standard carbonating components including a pump 50, a carbonator tank 52, and control electronics 54.

When the dispenser 10 is set up to operate with figals, a syrup line 68 from the figals is connected to an inlet end 80 of each syrup cooling coil by means of a 90° elbow fitting 66. When the dispenser 10 is to be used with a bag-in-box 90, the elbows 66 are each removed and replaced with a shock absorber tube 64 connected to the inlet end 80 of each syrup cooling coil and to a syrup line 70 to a bag-in-box. The tube 64 prevents vibrations from the pump from reaching the syrup cooling coils.

The pump mounting bracket 30 includes a first set of holes 60 for mounting five pumps and a second set of holes 62 for mounting six pumps. The bracket is preferably attached to the carbonator deck 24.

The water line 26 includes a first section 26 that goes to the pump 50, a second section 26A that goes under the evaporator coil 44 to a third section 26B which is a pre-cooling coil, to a fourth section 26C that goes to the carbonator tank 52, to a fifth section 26D that goes to a cooling section 26E, that goes to a section 26F to a manifold 26G from which individual sections 26H go to each of the valves.

The syrup pump has a syrup inlet port 82, a $CO_2$ inlet port 84, and a syrup outlet port 86. The $CO_2$ line 56 goes into the carbonator tank 52, and a branch line 58 is a $CO_2$ manifold from which individual lines 59 go to each pump.

The dispenser 10 can have some syrup coils connected to a bag-in-box and others connected to a figal.

While the preferred embodiment of this invention has been described above, it is to be understood that variations and modifications can be made therein. For example, while five valves are shown, more or fewer valves can be used, for example, the dispenser 10 can be setup with four valves, five valves, or six valves by providing the proper number of syrup cooling coils, and water coils, pumps and valves. It is not necessary to change beverage dispensing valves when converting between bag-in-box and figals. The dispenser 10 is not limited to use as a countertop dispenser and it is not essential that it be used with a built-in carbonator.

It should thus be apparent that various alterations, modifications, and changes can be made in the preferred embodiment illustrated here without departing from the spirit and scope of the present invention as defined in the appended claims.

What is claimed is:

1. A beverage dispenser comprising:

(a) a tank with a removable bonnet mounted thereon;

(b) a refrigeration system including a refrigeration deck removable mounted on top of said tank;

(c) a carbonator system including a carbonator deck removable mounted on top of said tank, a carbonator pump and a control module mounted on top of said carbonator deck, and a carbonator tank extending down from said carbonator deck into said tank;

(d) a syrup pump mounting bracket mounted on top of said tank and extending vertically upwardly and adapted to mount a plurality of syrup pumps;

(e) a plurality of beverage dispensing valves mounted on the front of said dispenser;

(f) said refrigeration system including a evaporator coil depending down from said refrigeration deck into said tank;

(g) a water inlet conduit in said tank extending into said carbonator pump, then extending from said carbonator pump into a pre-cooling coil located within the tank then extending outwardly of the tank to said carbonator tank, then extending from said carbonator tank back to a cooling coil within the tank and then to a water manifold having a plurality of separate water inlet tubes each going to a respective one of said valves; and (h) a plurality of separate, vertically oriented, syrup cooling coils located in said tank below said carbonator deck, each of said syrup cooling coils having an outlet end connected to a respective one of said valves.

2. The apparatus as recited in claim 1 including a plurality of syrup pumps connected to said bracket and each of said syrup pumps having a syrup inlet port connected to a syrup inlet conduit and having a syrup outlet port connected to a syrup inlet port of a respective one of said syrup cooling coils.

3. The apparatus as recited in claim 1 wherein a plurality of said syrup cooling coils are located generally in a plane perpendicular to the front of said dispenser, and one of said syrup cooling coils is located generally in a plane parallel to the front of said dispenser and between said carbonator tank and said front of said dispenser.

4. The apparatus as recited in claim 1 wherein said bracket has a first set of evenly spaced holes for mounting five pumps and a second set of evenly spaced holes for mounting six pumps.

5. The apparatus as recited in claim 1 wherein each of said syrup coils includes an inlet fitting for connecting to one of a syrup pump adapter tube or to a figal.

6. The apparatus as recited in claim 5 including a plurality of syrup pumps connected to said bracket and each of said syrup pumps having a syrup inlet port connected to a syrup inlet conduit and having a syrup outlet port connected to a syrup inlet port of a respective one of said syrup cooling coils, and wherein each of said syrup coils has a syrup pump adapter tube connected between its inlet fitting and a syrup outlet port of a respective one of said syrup pumps.

* * * * *